US010458748B2

(12) United States Patent
Yeates

(10) Patent No.: US 10,458,748 B2
(45) **Date of Patent: *Oct. 29, 2019**

(54) HOLSTER

(71) Applicant: Vista Outdoor Operations LLC, Anoka, MN (US)

(72) Inventor: Eric M. Yeates, Virginia Beach, VA (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/702,342

(22) Filed: Sep. 12, 2017

(65) Prior Publication Data

US 2018/0087869 A1 Mar. 29, 2018

Related U.S. Application Data

(63) Continuation of application No. 14/827,959, filed on Aug. 17, 2015, now Pat. No. 9,759,515, which is a (Continued)

(51) Int. Cl.
*F41C 33/02* (2006.01)

(52) U.S. Cl.
CPC ..... *F41C 33/0227* (2013.01); *F41C 33/0263* (2013.01); *F41C 33/0272* (2013.01); *Y10S 224/912* (2013.01); *Y10T 29/49863* (2015.01)

(58) Field of Classification Search
CPC .. F41C 33/02; F41C 33/0209; F41C 33/0218; F41C 33/0227; F41C 33/0254; (Continued)

(56) References Cited

U.S. PATENT DOCUMENTS 1,046,912 A 12/1912 Wanee
1,113,530 A 10/1914 Audley
(Continued)

FOREIGN PATENT DOCUMENTS

EP 2757271 A2 7/2014
WO WO2010/064268 A1 * 6/2010
(Continued)

*Primary Examiner* — Scott T McNurlen

(74) *Attorney, Agent, or Firm* — Christensen, Fonder, Dardi & Herbert PLLC

(57) ABSTRACT

A holster for a handgun that comprises a holster body with a handgun cavity for receiving and retaining the handgun by way of a obstructing member at the ejection port and at the rear portion of the handgun slide. Moreover, a single obscured push button actuates both mechanisms. An internal retention sleeve having an inverted U-shape is slidingly mounted within the holster body and movable between a first securement position and a second release position. The sleeve having an integral thumb button depressible downwardly whereby the sleeve moves downwardly within the body to release a ejection port stop catch and the latch hood. The sleeve biased toward a normal retention position, the handgun withdrawal obstructing member biased toward the normal retention position, the latch hood biased toward a release position but having a normal latched obstructing position until released by the sleeve.

14 Claims, 13 Drawing Sheets

Related U.S. Application Data continuation of application No. 13/911,710, filed on Jun. 6, 2013, now Pat. No. 9,134,093.

(60) Provisional application No. 61/684,615, filed on Aug. 17, 2012.

(58) Field of Classification Search

CPC ..... F41C 33/0263; F41C 33/0272; F41C 33/041; F41C 33/043; F41C 33/045; F41C 33/046; F41C 33/048; Y10S 224/912

USPC ..... 24/192–193, 198, 238, 243–244, 24/911–912; 224/192–193, 198, 238, 224/243–244, 911–912

See application file for complete search history.

(56) References Cited

U.S. PATENT DOCUMENTS 1,148,935 A 2/1915 Snavely
1,421,578 A 7/1922 Schussler
1,641,439 A 8/1925 Jovino
1,635,984 A 7/1927 Corriston
1,750,139 A 2/1928 Swift
1,851,352 A 3/1932 Denkert
1,951,865 A 3/1934 Franz
2,051,844 A 8/1936 Green
2,088,811 A 8/1937 Ray
2,109,734 A 3/1938 Preneta
2,349,376 A 5/1944 Ray
2,443,397 A 6/1948 Meyres
2,551,913 A 5/1951 Toby
2,577,869 A 12/1951 Adams
2,893,615 A 7/1959 Couper
3,289,903 A 12/1966 Taormina
3,419,728 A 12/1968 Wilson
3,420,420 A 1/1969 Clark
3,550,821 A 12/1970 Daigle
3,550,822 A 12/1970 Lloyd
3,669,325 A 6/1972 Furman
3,718,240 A 2/1973 Rose
3,777,952 A 12/1973 Theodore
3,804,306 A 4/1974 Azurin
3,828,990 A 8/1974 Baldocchi
3,866,811 A 2/1975 Hamby
3,904,091 A 9/1975 Jones
3,910,469 A 10/1975 Baldocchi
RE30,139 E 11/1979 Jones
4,277,007 A * 7/1981 Bianchi ..... F41C 33/0209 224/193
4,846,384 A 7/1989 Perry
5,018,654 A 5/1991 Rogers et al.
5,048,735 A 9/1991 McCormick
5,082,318 A 1/1992 Held et al.
5,094,376 A 3/1992 Baruch
5,100,036 A 3/1992 Rogers et al.
5,127,566 A 7/1992 Beletsky
5,129,562 A 7/1992 Bianchi
5,199,620 A 4/1993 Beletsky
5,215,238 A 6/1993 Baruch
5,275,317 A 1/1994 Rogers et al.
5,284,281 A 2/1994 Nichols
5,322,200 A 6/1994 Blanchard
5,358,160 A 10/1994 Bianchi
5,372,288 A 12/1994 Rogers et al.
5,395,021 A 3/1995 Brown
5,419,474 A 5/1995 Marx et al.
5,421,497 A 6/1995 Gilmore
5,449,103 A 9/1995 Tilley
5,458,266 A 10/1995 Pichot
5,467,909 A 11/1995 Resca et al.
5,501,380 A 3/1996 Wu
5,501,381 A 3/1996 Rogers et al.
5,509,591 A 4/1996 Carver
5,513,785 A 5/1996 Campagna, Jr.
5,518,155 A 5/1996 Gallagher
5,551,611 A 9/1996 Gilmore
5,570,830 A 11/1996 Nichols
5,573,157 A 11/1996 Mauriello et al.
5,598,958 A 2/1997 Ryan, III et al.
5,611,164 A 3/1997 Rassias
5,749,507 A 5/1998 Wood
5,758,448 A 6/1998 Thummel
5,768,816 A 6/1998 Rassias
5,779,114 A 7/1998 Owens
5,806,739 A 9/1998 Wood
5,810,221 A 9/1998 Beletsky et al.
5,810,222 A 9/1998 Shoemaker
5,855,305 A 1/1999 Nichols
5,916,087 A 6/1999 Owens
5,918,784 A 7/1999 Serpa
5,927,578 A 7/1999 Kay
5,944,239 A 8/1999 Rogers et al.
5,961,013 A 10/1999 Collins
6,085,951 A 7/2000 Beletsky et al.
6,112,962 A 9/2000 Matthews
6,149,042 A 11/2000 Rassias
6,189,751 B1 2/2001 Tserng
6,230,946 B1 5/2001 Vor Keller et al.
6,267,279 B1 7/2001 Matthews
6,276,581 B1 8/2001 Glock
6,320,975 B1 11/2001 Vieweg
6,349,496 B1 2/2002 Neely
6,389,726 B1 5/2002 Bentley
6,415,541 B1 7/2002 Rassias
6,467,660 B1 10/2002 Rogers et al.
6,523,374 B1 2/2003 Owens
6,533,149 B2 3/2003 Vor Keller et al.
6,547,111 B2 4/2003 French
6,585,209 B1 7/2003 Mattingly
6,588,635 B2 7/2003 Vor Keller et al.
6,604,657 B2 8/2003 Yirmiyahu et al.
6,616,020 B1 9/2003 Spielberger
6,634,527 B2 10/2003 Lui
6,641,009 B2 11/2003 French et al.
6,732,891 B2 5/2004 Locklear, III
6,752,300 B2 6/2004 Har-Shen
6,755,331 B2 6/2004 Rassias
6,769,581 B2 8/2004 Rogers et al.
6,769,582 B1 8/2004 Beletsky et al.
6,799,392 B2 10/2004 Milec et al.
6,854,626 B2 2/2005 Liao
6,886,725 B2 5/2005 Lowe et al.
6,918,519 B2 7/2005 Vor Keller et al.
6,948,644 B1 9/2005 Beletsky
7,140,523 B2 11/2006 Lowe et al.
7,200,965 B2 4/2007 Vor Keller et al.
7,434,712 B2 10/2008 Cook et al.
7,461,765 B2 12/2008 French et al.
7,530,456 B1 5/2009 Tsai
7,543,404 B2 6/2009 Kovalchuk et al.
7,556,181 B2 7/2009 Spielberger
7,562,797 B2 7/2009 Senn et al.
7,584,875 B2 * 9/2009 Lowe ..... F41C 33/0209 224/193
7,591,402 B2 9/2009 Rassias
7,644,845 B2 1/2010 Lowe
7,694,860 B2 4/2010 Clifton, Jr.
7,819,294 B2 10/2010 Lowe et al.
7,841,497 B1 11/2010 Gregory et al.
7,850,053 B2 12/2010 Rassias
7,922,050 B2 4/2011 Benes
7,937,880 B1 5/2011 Fidlow
7,950,553 B2 5/2011 Rassias
7,954,971 B1 6/2011 Kincaid et al.
8,052,018 B2 11/2011 Gallagher
8,096,453 B2 1/2012 Lowe et al.
8,132,355 B1 3/2012 Kincaid et al.
8,141,758 B2 3/2012 Spielberger
8,177,108 B1 5/2012 Kincaid et al.
8,215,525 B2 7/2012 Rassias
8,235,263 B1 8/2012 Yeates et al.
8,281,512 B2 10/2012 Lara
8,302,827 B1 11/2012 Cole
8,371,487 B1 2/2013 Plappert

(56) References Cited

U.S. PATENT DOCUMENTS

| | | | |
|---|---|---|---|
| 8,474,670 | B1 | 7/2013 | Gregory et al. |
| RE44,428 | E | 8/2013 | Spielberger |
| 8,517,235 | B1 | 8/2013 | Kincaid et al. |
| 8,544,706 | B2 | 10/2013 | Crye |
| 8,602,275 | B1 | 12/2013 | Kiger et al. |
| 8,602,276 | B2 | 12/2013 | Tyybakinoja |
| 8,631,981 | B2 | 1/2014 | Zusman |
| 8,646,665 | B2 | 2/2014 | Abushaev |
| 8,690,032 | B2 | 4/2014 | Baumann et al. |
| 8,720,753 | B2 | 5/2014 | Benes |
| 8,720,754 | B2 | 5/2014 | Kirsch |
| 8,720,755 | B2 | 5/2014 | Gregory et al. |
| 8,807,404 | B1 | 8/2014 | Howell et al. |
| 8,851,344 | B2 | 10/2014 | Baumann et al. |
| 8,870,042 | B2 | 10/2014 | Clifton |
| 8,910,839 | B2 | 12/2014 | Clifton |
| 8,925,773 | B2 | 1/2015 | Clifton |
| 8,985,412 | B2 | 3/2015 | Rorick et al. |
| 9,016,533 | B2 | 4/2015 | Visalli et al. |
| 9,022,262 | B2 | 5/2015 | Pellegrini |
| 9,057,579 | B2 | 6/2015 | Rorick et al. |
| 9,057,580 | B2 | 6/2015 | Rorick et al. |
| 9,134,093 | B2 | 9/2015 | Yeates |
| 9,175,925 | B2 | 11/2015 | Pellegrini |
| 9,228,802 | B2 | 1/2016 | Ribas |
| 2004/0050887 | A1* | 3/2004 | Spielberger ..... F41C 33/0245 224/244 |
| 2005/0205621 | A1 | 9/2005 | Shults |
| 2005/0205624 | A1 | 9/2005 | French et al. |
| 2005/0279789 | A1 | 12/2005 | Lowe |
| 2006/0156525 | A1 | 7/2006 | Jenkins et al. |
| 2006/0157520 | A1 | 7/2006 | Clifton, Jr. |
| 2006/0175366 | A1 | 8/2006 | Dekaise |
| 2006/0226185 | A1 | 10/2006 | Har-Shen |
| 2007/0181619 | A1* | 8/2007 | Seyfert ..... F41C 33/0227 224/196 |
| 2008/0110947 | A1 | 5/2008 | Pikielny |
| 2008/0121670 | A1 | 5/2008 | Buress |
| 2008/0179360 | A1 | 7/2008 | Lowe et al. |
| 2009/0321480 | A1 | 12/2009 | Kincaid et al. |
| 2010/0276464 | A1 | 11/2010 | Hirt et al. |
| 2011/0011904 | A1 | 1/2011 | Schultz et al. |
| 2011/0101063 | A1 | 5/2011 | Zusman |
| 2011/0163138 | A1 | 7/2011 | Tyybakinoja |
| 2011/0174850 | A1* | 7/2011 | Clifton, Jr. ..... F41C 33/0209 224/243 |
| 2013/0240582 | A1 | 9/2013 | Tyybakinoja et al. |
| 2014/0048572 | A1 | 2/2014 | Yeates |
| 2014/0109345 | A1 | 4/2014 | Melville |

FOREIGN PATENT DOCUMENTS

| | | | |
|---|---|---|---|
| WO | WO 2010/064268 | A1 | 6/2010 |
| WO | WO 2013/071402 | A1 | 5/2013 |
| WO | WO2014/028876 | A1 | 2/2014 |
| ZA | 986778 | | 2/1999 |

* cited by examiner

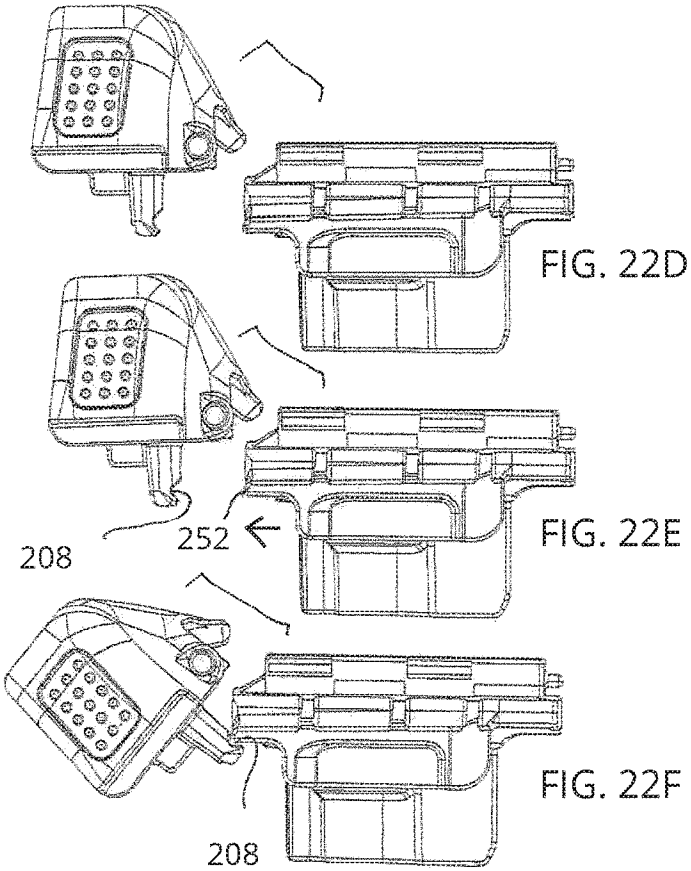
FIG. 22D
FIG. 22E
FIG. 22F
252
208
208
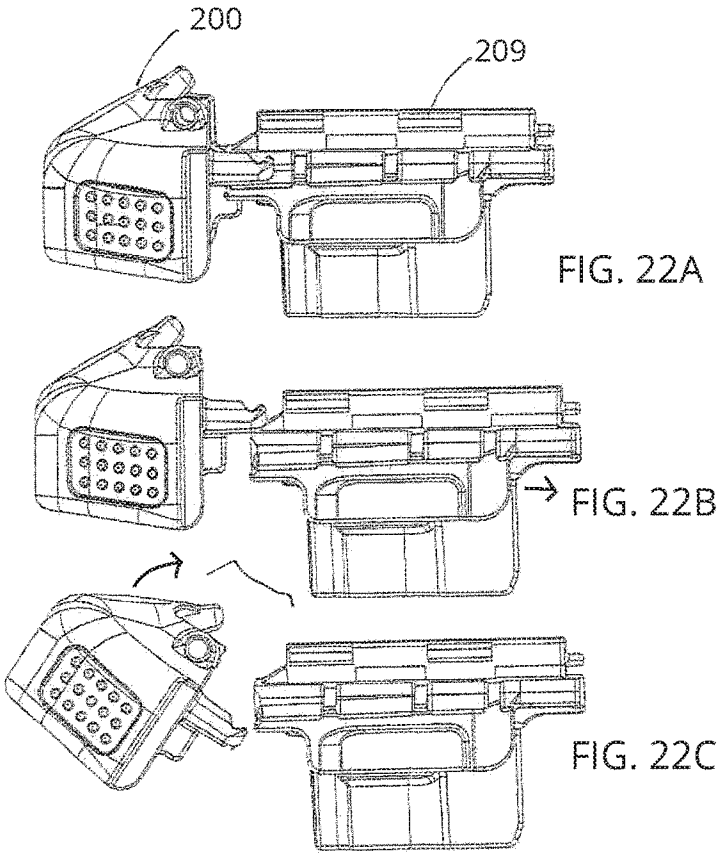
FIG. 22A
FIG. 22B
FIG. 22C
209
200

HOLSTER

CROSS-REFERENCE TO RELATED APPLICATIONS

The present application is a continuation of U.S. patent application Ser. No. 14/827,959 filed Aug. 17, 2015, which is a continuation of U.S. patent application Ser. No. 13/911,710, filed Jun. 6, 2013, now U.S. Pat. No. 9,134,093, which claims the benefit of U.S. Provisional Patent Application No. 61/684,615, filed Aug. 17, 2012, all of which are hereby incorporated by reference herein in their entireties.

BACKGROUND OF THE INVENTION

Current rigid polymer holsters that utilize retention mechanisms for preventing removal of the handgun typically secure the handgun at the trigger guard Holsters that utilize trigger guard latch mechanisms generally cannot accommodate accessories mounted forwardly of the trigger guard of the handgun, such as laser sights. Moreover, a particular holster design for different handguns, or for the same handgun with accessories, will typically require entirely new component configurations for a particular model of holster. This is due to the requirement for proper operation of the release mechanism of a very close form fit between the handgun and the holster. Such requires different mold sets for each configuration greatly increasing manufacturing cost. Additionally when a holster has more than one retention feature, often mechanisms are either complicated, not reliable, and/or the actuation buttons are readily visible. It would be advantageous to have less visible release buttons on a holster, capability of capturing handguns with accessories forward of the trigger guard. Also, the capability for utilizing common components in holsters for different handguns would be beneficial in a cost perspective.

SUMMARY

Accordingly, embodiments of the present invention address the above with a holster for a handgun that comprises a holster body with a defined handgun cavity for receiving and retaining the handgun at the ejection port and at the rear end of the handgun slide. Moreover, a single obscured push button actuates both mechanisms. The holster comprising a holster body having an upper opening for inserting and removing the handgun, a cavity for receiving the handgun and having a bottom or lower wall portion and a first and an opposite second side wall, a forward wall and a rearward wall portion. A pivot guard or latch hood configured is pivotally connected between the first and second walls adjacent to the forward wall portion and at the upper opening, the latch hood having a capture position extending over the handgun slide end and a release open position with a spring bias towards the release open position. An internal retention sleeve having an inverted U-shape is slidingly mounted within the holster body at the forward wall portion and extending downwardly to the first and second side walls. The U-shaped sleeve movable between a first securement position and a second release position. The U-shaped sleeve sized to receive and move along an upper portion of the handgun, primarily the slide. The sleeve having an integral thumb button depressible downwardly whereby the sleeve moves downwardly within the body. A resilient cantilevered leaf spring has an ejection port stop catch, an actuation portion and an end secured to the body. The stop catch being in an obstructing position with the ejection port in a first normal position and movable to a second release position. The actuation portion engageable with an engagement portion of the sleeve, at least one of the intermediate portion and sleeve having a cam wedge portion whereby when the sleeve is moved downwardly, the leaf spring is deflected out of the obstructing position with the ejection port.

The sleeve further having a latch hood engagement portion and the latch hood further having a sleeve engagement portion that cooperate with each other, whereby the latch hood engagement portion and the sleeve engagement portion are latchable together when the latch hood is in the capture position for retaining the latch hood in said capture position, and wherein sliding the U-shaped slide portion forwardly toward the second release position disengages the latch hood engagement portion and the sleeve portion engagement portion allowing the latch hood to open to the release position driven by the bias of the latch hood toward the release position.

After the handgun is removed, the latch hood remains open. Resetting the retention mechanisms is accomplished by replacing the gun in the holster, slightly depressing the push button and rotating the latch hood to the capture position and then releasing the push button such that the cooperating engagement portions of the sleeve and the latch hood are engaged.

A feature and advantage of embodiments of the invention is the retention sleeve that is removable from the holster body. The removable retention sleeve can have various shapes and sizes for different handguns so that a particular retention sleeve can fit into the holster body and then be switched out with another retention sleeve, depending on the desired type of handgun for use. Thus, manufacturing costs for holsters for different handguns can be reduced. In embodiments, the end consumer may be able to switch out the sleeves.

In particular embodiments, the latch hood is in a closed position when the latch hood is engaged with the retention sleeve. To engage the retention sleeve with the latch hood, the retention sleeve may have at least one or more projections or prongs that slide into or fit into compartments, sleeves, or pockets of the latch hood. Alternatively, the latch hood may have one or more projections or prongs that fit into or slide into compartments, sleeves, or pockets of the retention sleeve.

Embodiments of the invention include the individual mechanisms as well. A feature and advantage of embodiments is a latch hood operated by a push button attached to an axially movable member that slide or moves out of a latching engagement with the latch hood and the latch hood by way of a spring bias rotates to the open position allowing removal of the handgun.

The retention sleeve may include at least one projecting that extends out on one end of the retention sleeve. In one embodiment, the projecting component extends towards the front of the gun, downwardly in the holster body, and is sized to capture a spring. The spring engages a spring catch of the interior of the holster body to provide a bias of the sleeve towards the open top of the holster. A feature and advantage of the holster is that the pivoting latch hood can remain open when the handgun is reholstered to provide a lesser retention level than with the latch hood in a capture position.

A feature and advantage of embodiments is the release lever coupled to the retention sleeve. When the release sleeve and latch hood are engaging with each other, pressing downward (or forward) on the release lever simultaneously or sequentially actuates and disengages the catch wedge of the latch member from the ejection port of a handgun and disengages the prongs from the latch hood from the compartments, pockets, or sleeves of the retention sleeve. A spring or other resilient material may be placed underneath ejection port capture member for primary or supplemental bias in the obstruction position with the ejection port.

A feature and advantage of embodiments of the invention is that the retention of the firearm at the slide allows the holster to be configured to receive firearms with laser illumination sights units mounted forwardly of the trigger guard. Conventional holsters with trigger guard retention mechanisms cannot receive firearms with such laser sights.

A feature and advantage of embodiments of the invention is a single thumb actuated push button that releases the spring loaded pivoting latch hood h and a gun withdrawal obstruction member. In embodiments the obstruction member may be on the trigger guard, in embodiments on the ejection port.

A feature and advantage of embodiments of the invention is that a single motion with the thumb depression can actuate the latch hood to snap open providing a provocative signal to a potential suspect that the gun may be deployed. A feature and advantage of the embodiments of the invention is that the actuation button is not readily visible. Moreover, in embodiments, the push button is positioned in a difficult to access position by others not wearing the holster. In embodiments the button is forward of the hood and intermediate the firearm and holster attachment portion, for example, a belt clip. Also, the user may mute the latch hood "snap" by preventing it from snapping open with the same hand actuating the push button.

The holster can attach to a holster holding device so that the holster can hang from a particular location, like the belt of a user. The holster holding device can attach to the outside of the holster by lining up a mounting plate located in the interior of the holster body with the holster holding device located on the exterior of the holster body. In one embodiment, the holster body, mounting plate, and holster holding device will each have a set or series of sets of holes that can be lined up and then fastened together, i.e. a screw.

These and other features and aspects of the present invention may be described below in connection with some exemplary embodiments of the invention and other attributes and benefits of the foregoing will be apparent to one of ordinary skill in the art from the following drawings and detailed description. Other holsters which disclose mechanisms and configurations that are suitable for portions of embodiments of the invention of this application are illustrated in U.S. Patent/Publication Nos. US 2007/0181619, US 2011/0163138, U.S. Pat. Nos. 7,694,860 and 7,556,181, which are incorporated by reference herein.

In an embodiment of the invention, a holster shell with a insertion/withdrawal direction, a thumb pushbutton is on one side of the holster and connects to linkage that transfers a downward motion of the button on the one side to an opposite side of the holster and the linkage engages an ejection port obstruction member that has an obstructing position and a release position with respect to engagement of a handgun at the ejection port, the handgun in the holster shell, the ejection port obstruction member being movable to a release position by the downward motion. The obstruction member biased to a normal obstruction position. In embodiments, the pushbutton retains a pivoting hood, positioned above a rear portion of a slide of the handgun, in a retention position, the actuation of the pushbutton releasing the pivoting hood to a non-retention position, the hood biased, such as by a spring, to the non-retention position.

The above summary of the various representative features and aspects of the present invention is not intended to describe each illustrated embodiment or every implementation of the present invention. Rather, the various representative features and aspects are chosen and described so that others skilled in the art may appreciate and understand the principles of certain aspects of the present invention. The figures in the detailed description that follows more particularly exemplify such aspects of the present invention.

DESCRIPTION OF THE FIGURES

FIG. 22A is a side view of the latch hood in a retention position secured in place by the actuation sleeve, for purposes of clarity, the holster body is not shown.

FIG. 22B is a side view of the latch hood of FIG. 22A with the manual pushbutton of the actuation sleeve being depressed commencing the handgun release sequence.

FIG. 22C is a side view of the latch hood of FIG. 22A with the sleeve moved to the release position allowing the pivot hood to snap open.

FIG. 22D is a side view of the latch hood of FIG. 22A with the pivot hood in the release-full open position and the sleeve full forward.

FIG. 22E is a side view of the latch hood of FIG. 22A with the sleeve retracted.

FIG. 22F is a side view of the latch hood of FIG. 22A with the obstruction of the pivoting of the latch hood when the sleeve has not been pushed forward.

DETAILED DESCRIPTION

Figure 1:
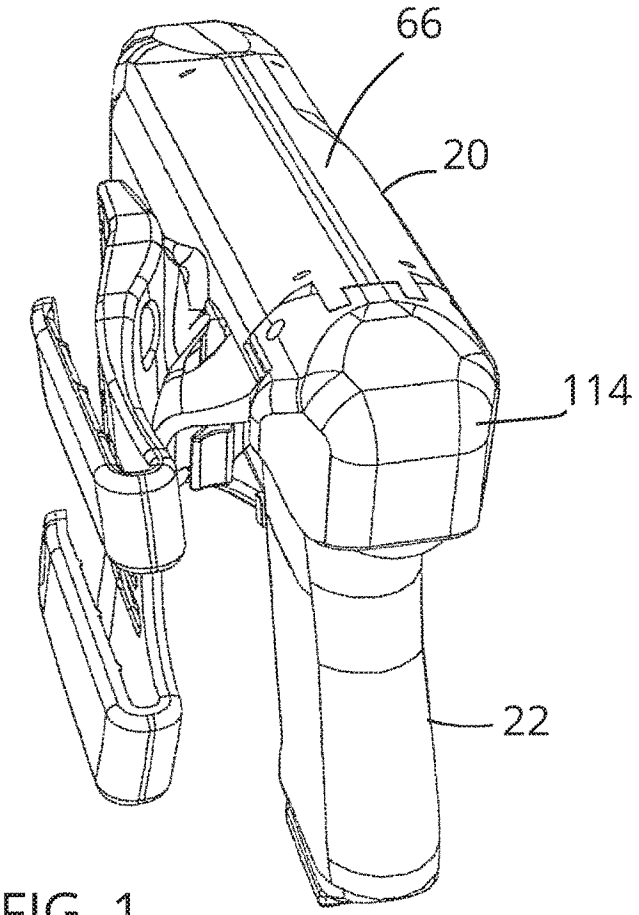
FIG. 1 is a top perspective view of a holster according to embodiments of the invention.
Figure 2:
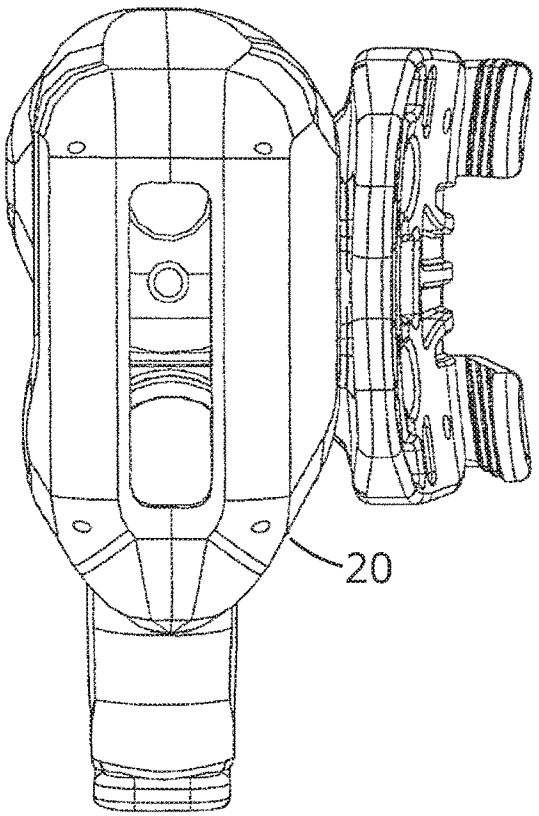
FIG. 2 is a bottom perspective view of the holster of FIG. 1.
Figure 3:
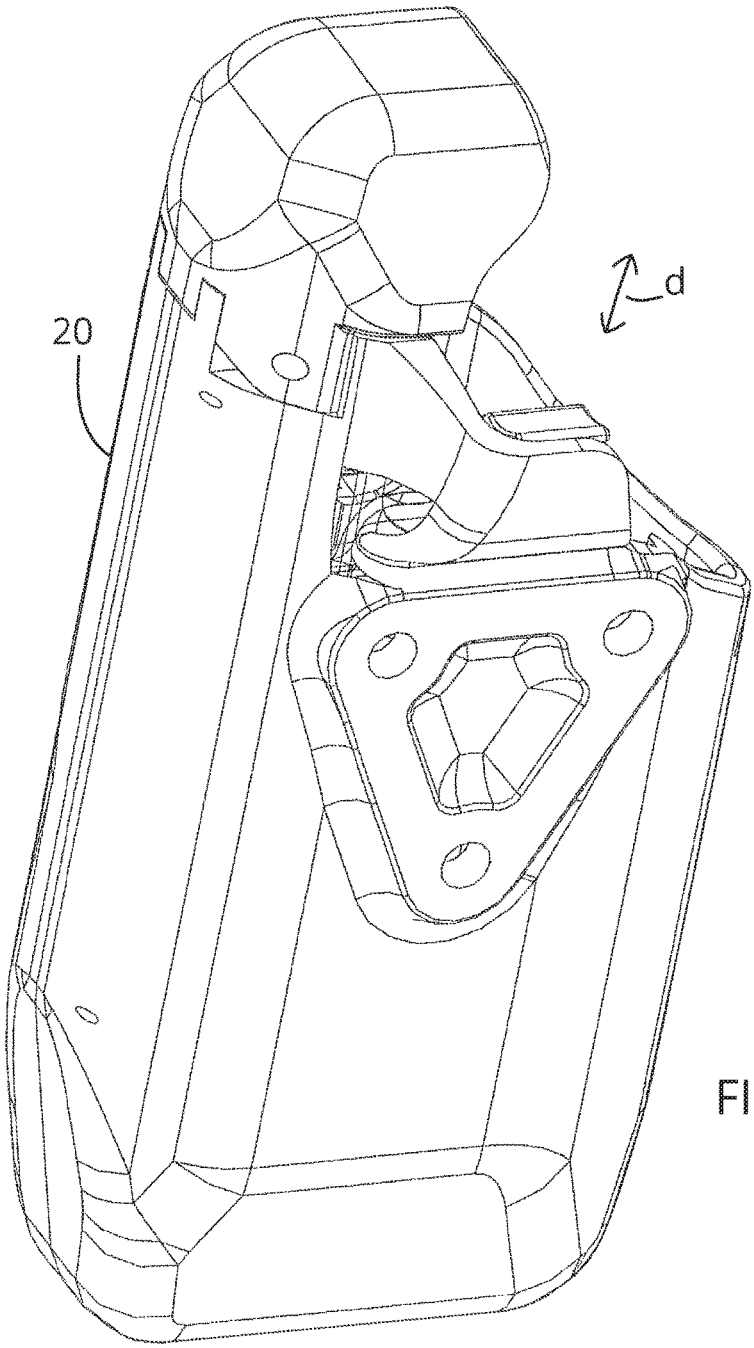
FIG. 3 is a side elevational view of the holster with the belt clip removed in accord with embodiments of the invention.

Referring to FIGS. 1-7, a holster 20 is configured to receive a handgun 22 and in particular embodiments is equipped with two retention means commonly actuated. The holster comprises generally a holster body 30, linkage configured as a slidably engaged internal retention sleeve 34 connected to the body, a handgun withdrawal obstructing member 40 configured as an ejection port obstruction member connected to the body, and a latch hood 46 connected to the body. A holster holding device such as an attachment clip 50 may be used to secure the holster to a belt or other harness. The handgun is a conventional semi-automatic with a slide 51 and ejection port 52 with a surface 55 that extends transverse to the direction d of insertion and removal of the firearm. The holster has a longitudinal axis a extending parallel to the insertion/withdrawal direction. Of note, the holster provides functionality even when the handgun has accessories such as laser illumination sights 53.

The holster body 30 or shell may be formed from two clam shell type halves 54, 56 that may be secured together by fasteners 58 or the body may be unitarily formed. The body has a bottom portion 60, sidewalls 62, 64, a forward wall portion 66, a rearward wall portion 68, and, an open top 70.

Referring to FIGS. 4, 7, 8, 9, 10 and 11, the U-shaped retention sleeve is shown in detail. The U-shaped sleeve is a motion transfer linkage to transfer the thumb downward motion to the opposite side of the holster where the ejection port of the slide is located. The sleeve has a top slide portion 76 which engages a cooperating groove 78 configured as a channel formed into the forward wall portion of the holster body. In other embodiments an axially extending groove may be provided in the slide to engage protruding portions extending from the body or shell. The sleeve has a forward spring catch 82 engaged with a spring 84 that is also engaged with the holster body, such as in a recess 85, to provide a bias to the sleeve towards the open top 70 of the holster. The sleeve further has a lever or pushbutton handle 86 integrally formed such as by injection molding with the slide portion 88 of the sleeve. The thumb button may be advantageously positioned between the firearm and a holster holding device, such as the clip illustrated. Latch hood engagement portions 90 provide recesses for cooperative engagement of the latch hood. The sleeve also has an engagement portion 94 configured as a surface defining a recess, an opening, an aperture or window for engaging the ejection port obstructing member 40 as the sleeve. Such a recess, an opening, an aperture or window provides a guide-in effect to minimize misalignments of the components and added reliability in the release function.

Figure 6:
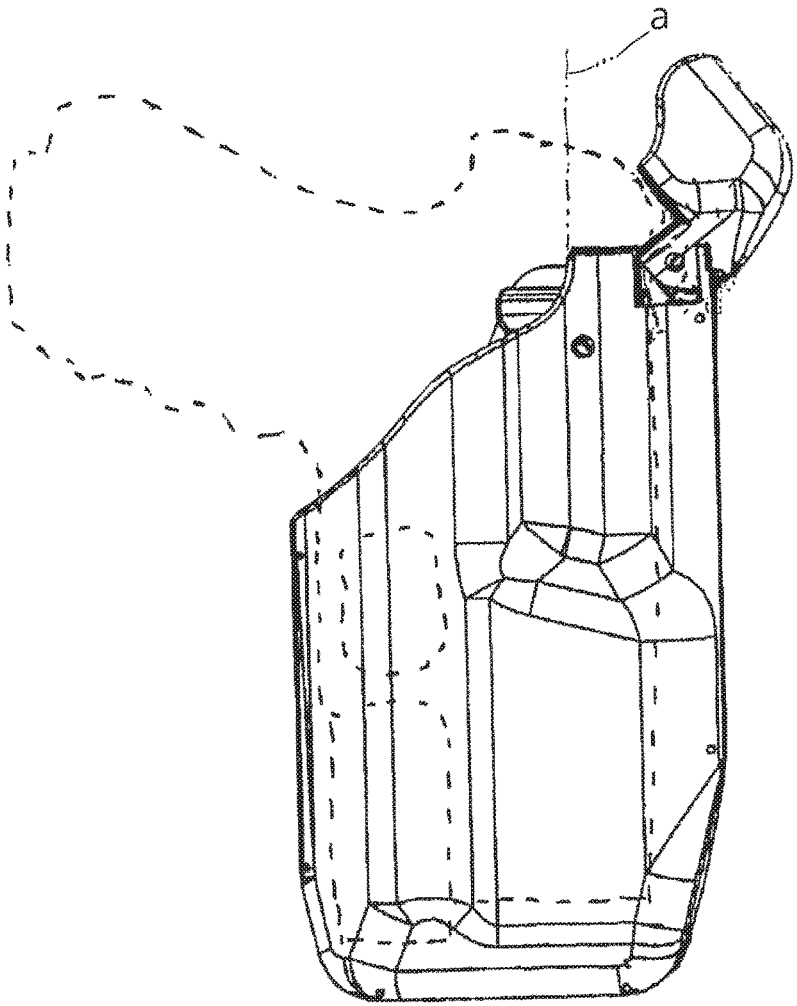
FIG. 6 is a view of the holster of FIG. 5 with the latch hood released for removal of the handgun in accord with embodiments of the invention.

The latch hood 46, or rear pivot guard, has sleeve engagement portions 102, 104 which cooperate and engage with the sleeve at the recesses 90 of the sleeve to prevent pivoting of the latch hood. The latch hood may be pivotally attached to the holster body by way of a pin 108 and may be biased towards an open unlatched position as illustrated in FIG. 6 by way of a torsion spring 112. The latch hood has a handgun slide obstructing cap portion 114 which when in a closed retention or capture position precludes removal of the handgun by obstructing the rear slide portion 115 of the handgun. The handgun is installed in the holster with the latch hood in the open release position as illustrated in FIG. 6.

Figure 4:
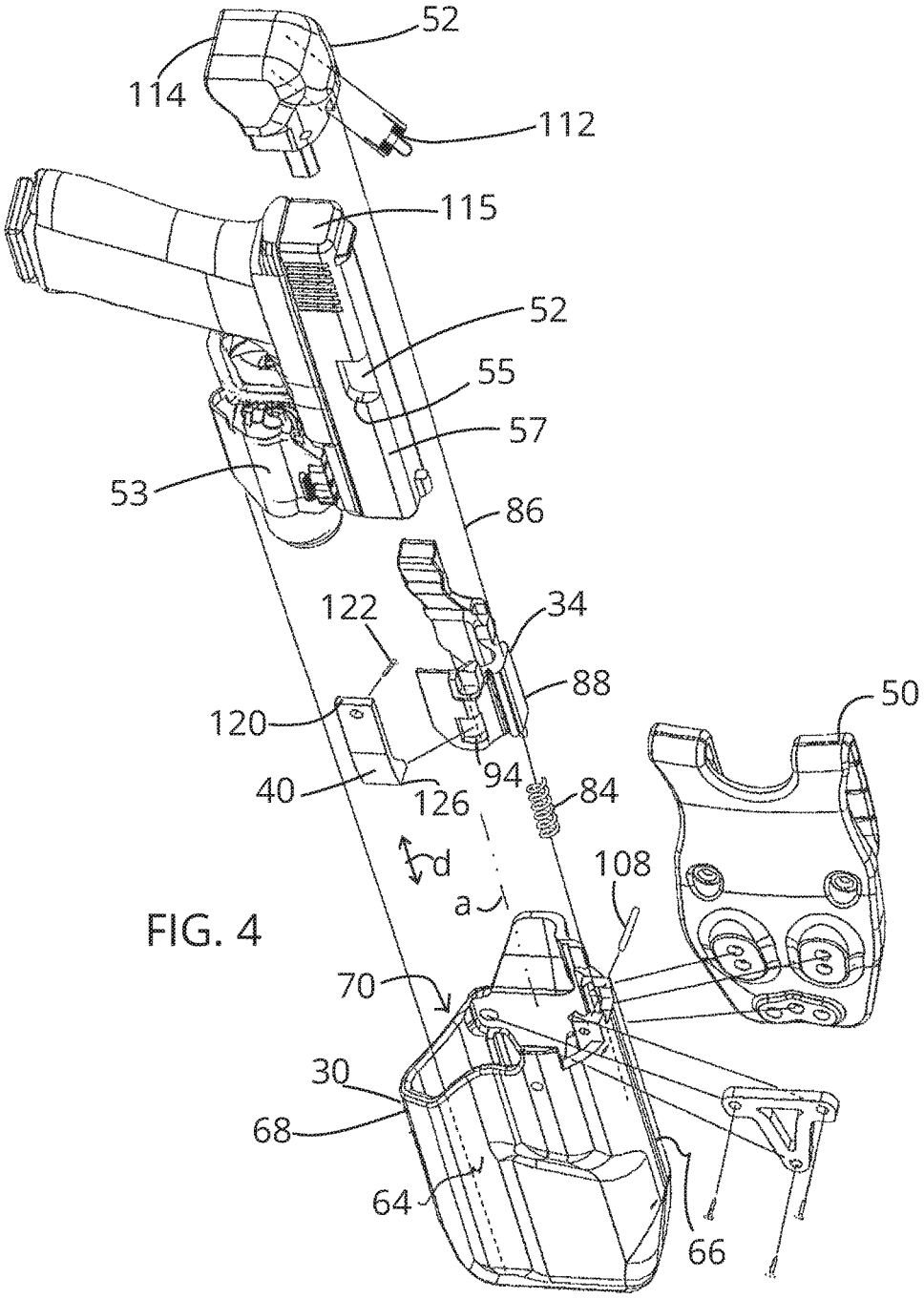
FIG. 4 is an exploded view of a holster and handgun in accordance with the invention.
Figure 5:
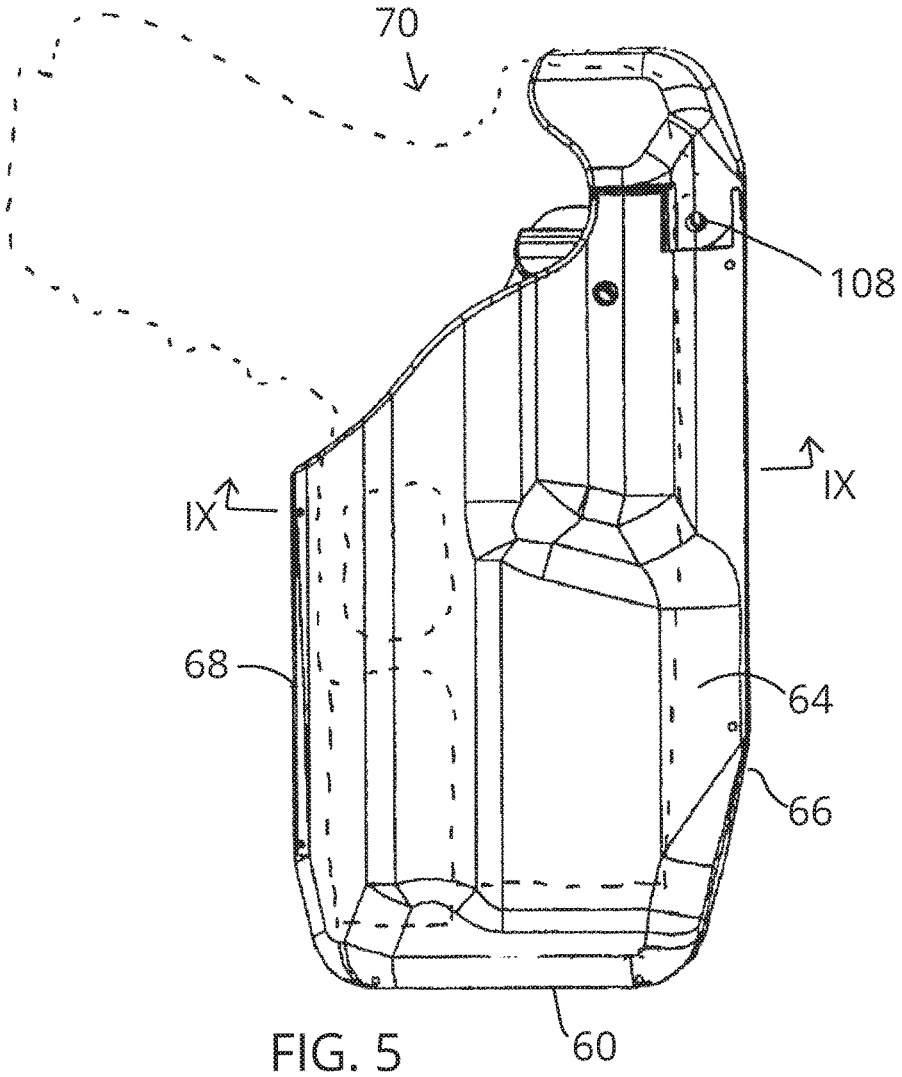
FIG. 5 is a side elevational view of a holster in accord with the invention with the handgun shown in phantom.
Figure 7:
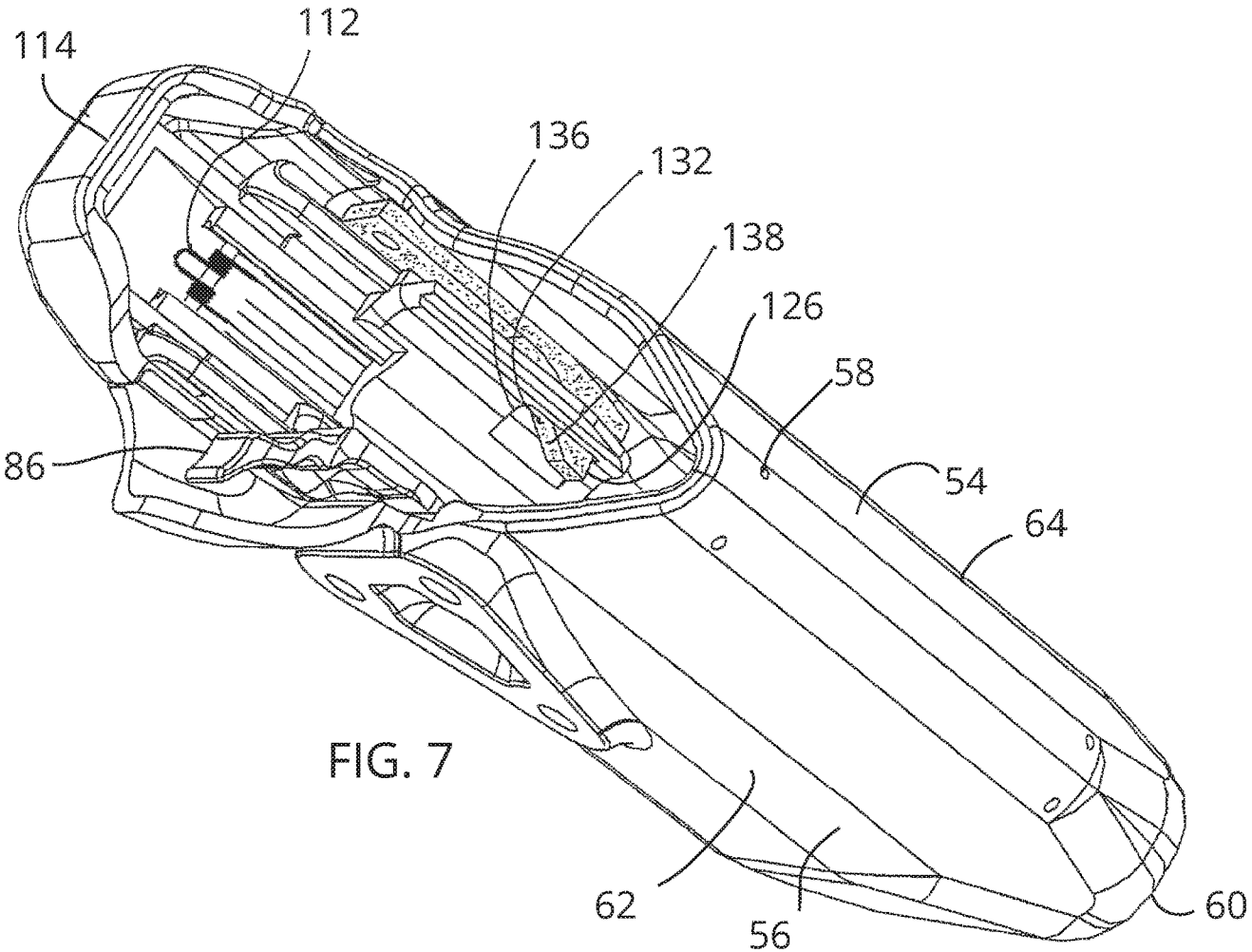
FIG. 7 is top perspective view showing the inside of the holster with the obstruction member shown stippled for purposes of clarity.
Figure 8:
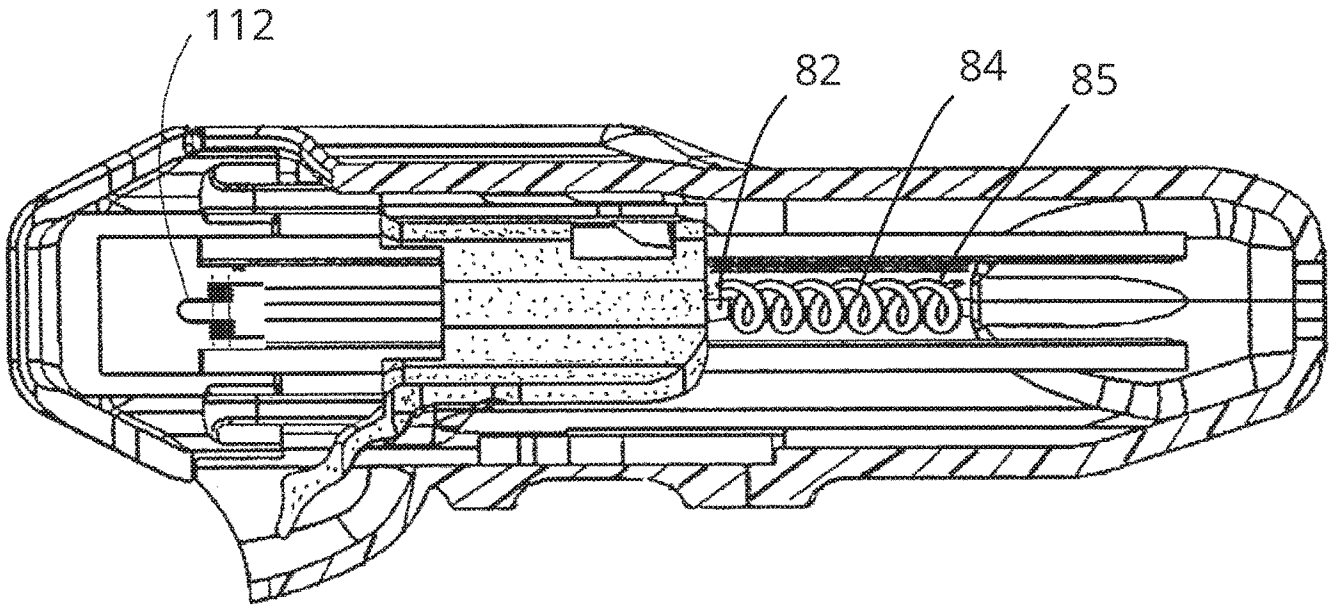
FIG. 8 is a cross-sectional view of the front of the holster with the retention sleeve shown stippled for clarity purposes.
Figure 9:
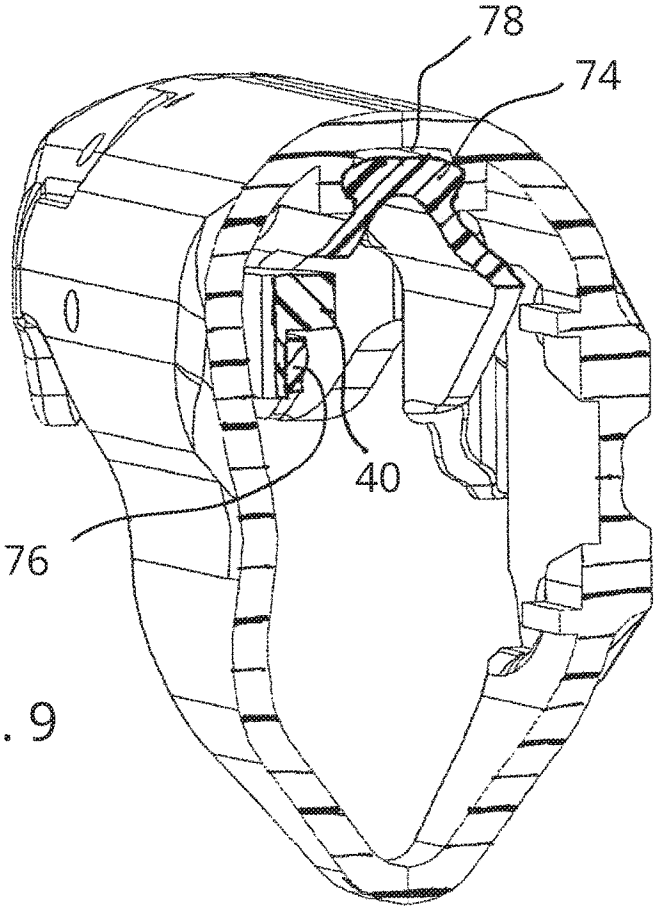
FIG. 9 is a cross-sectional view of the holster illustrating the sliding engagement of the sleeve with the holster body in accord with embodiments of the invention. The cross section taken at about line.

The ejection port obstruction member 40 is best illustrated in FIGS. 4, 7 and 9 and provides a capture or retention position and a release position by engaging a surface that extends transverse to the direction d of insertion and removal of the firearm. The surface may be an edge or edge surface of an ejection port of the slide. Alternative transverse surfaces may be utilized depending on the firearm and may also comprise a transverse surface on an accessory added to the firearm. The obstruction member 40 may be configured as a leaf spring with a first end 120 that is secured to the side wall 64 of the holster body by way of a fastener such as a screw 122, rivet, welding, or other means. The ejection port capture member may have a catch at the opposite second end 126. The capture member may be configured as a resilient leaf spring utilizing the resiliency of the leaf spring material to resiliently provide a normal position of retention by obstructing the ejection port of a handgun in the holster. The catch end 126 may have an angle that is best illustrated in FIG. 7 for enhanced securement at the ejection port. The catch member also has an engagement portion 132 that cooperates with the U shaped sleeve 34 at an engagement portion 136. The engagement provides that as the sleeve is depressed downwardly a cam follower or wedge surface 138 on the ejection port catch member is engaged by an engagement surface configured as a cam surface on the sleeve causing said ejection port capture member to move towards the side wall and away from the engagement position with the ejection port of the handgun. In other embodiments the obstruction member may be pivotally attached to the body with a retention position and a release position with the retention position blocking removal of the firearm by obstruction of a surface transverse to the insertion and removal directions of the firearm in the holster. The obstruction member may be biased by a spring to the obstructing position.

The holster holding device 50 may extend upwardly and provides restricted access to the thumb-release button. The holster may be disassembled such as by removal of the hood pin 108 and then sliding removal of the sleeve. Different sleeves may be utilized to convert the holster to conform to different firearms. In embodiments of the invention, a kit may be provided with a shell and differently configured sleeves to accommodate different handguns. Also, in embodiments, more than one obstructing member may be provided with such kits.

Figure 10:
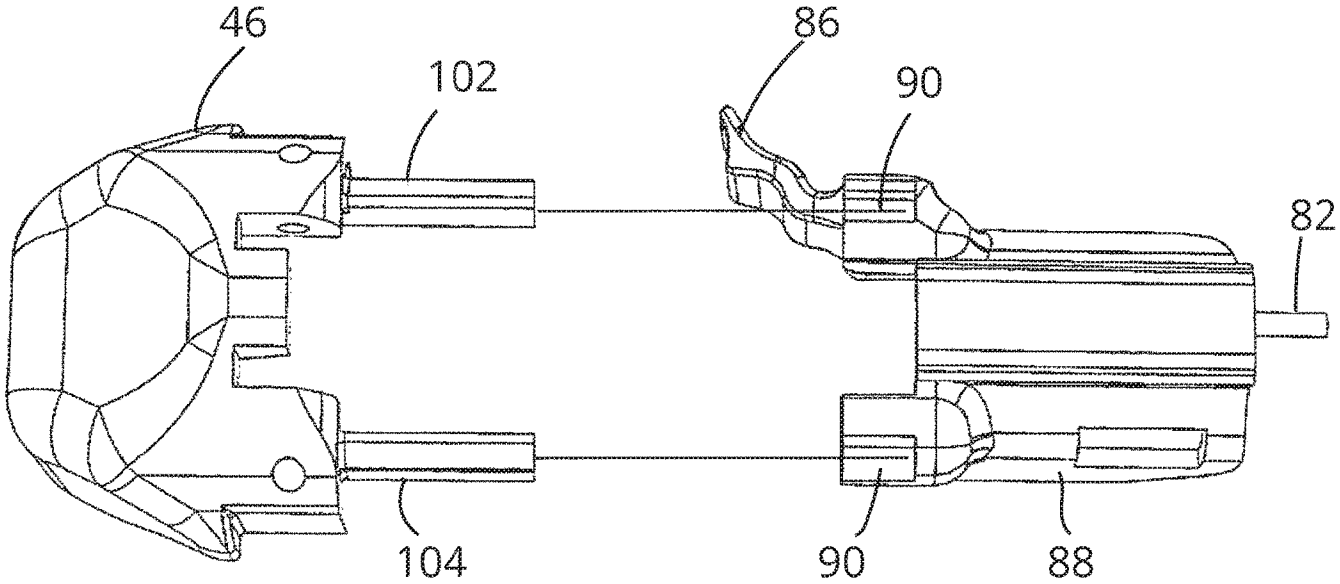
FIG. 10 illustrates the engagement mechanisms of the latch hood to the sleeve.
Figure 11:
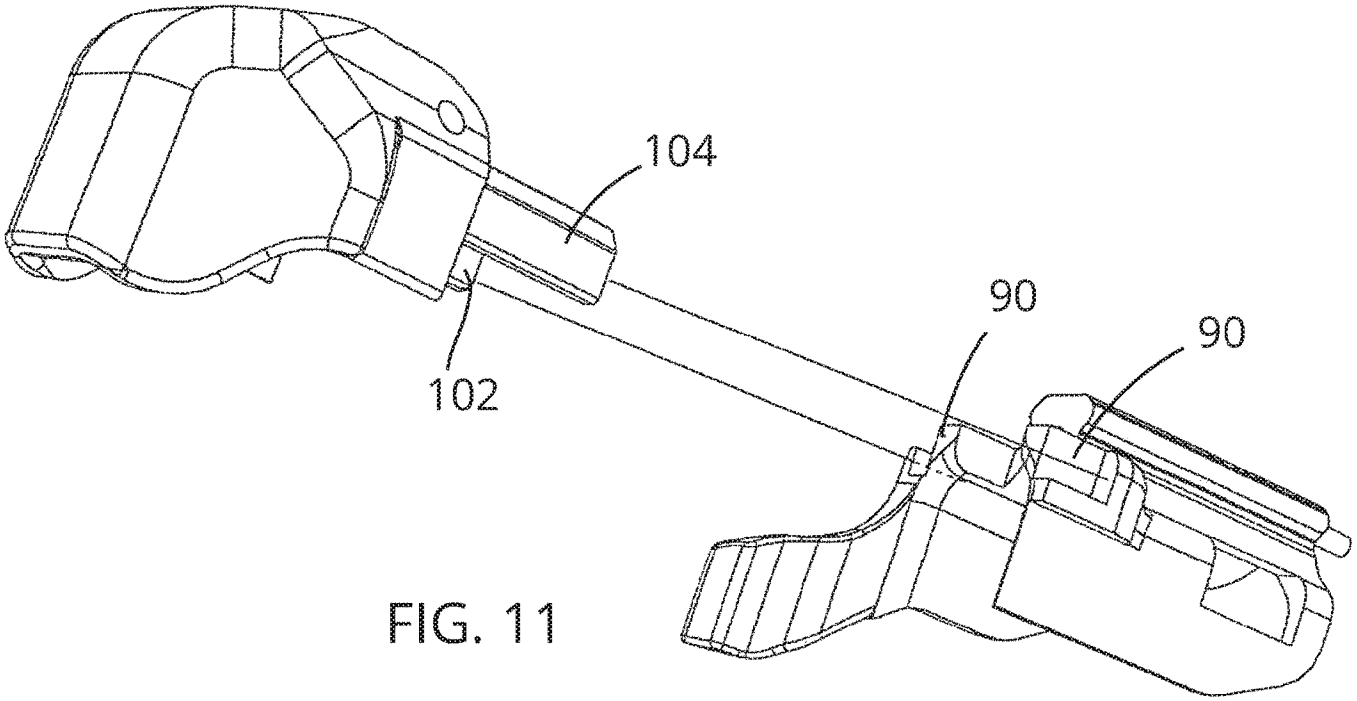
FIG. 11 is another view of the engagement of the latch sleeve to the hood.
Figure 12:
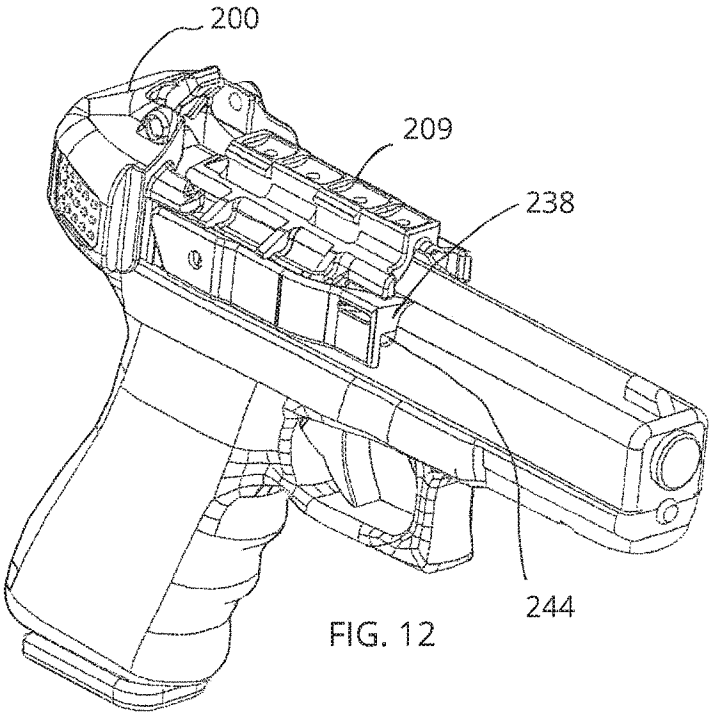
FIG. 12 is a perspective view of a handgun with two retention means and the actuation sleeve thereon without the shell illustrated for purposes of clarity.
Figure 13:
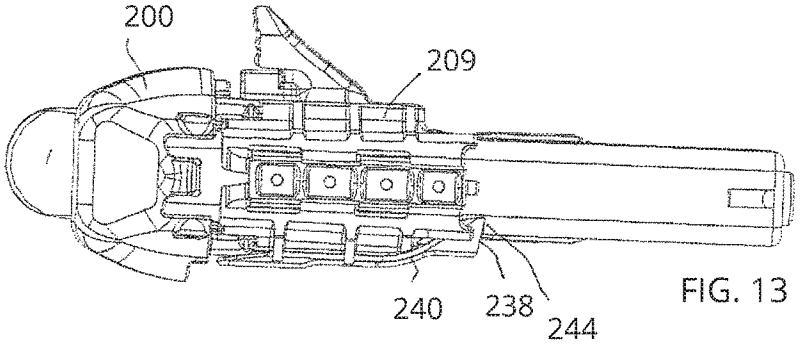
FIG. 13 is a view of the top of the gun (or the front of the holster) illustrating the retention means of FIG. 12.
Figure 15:
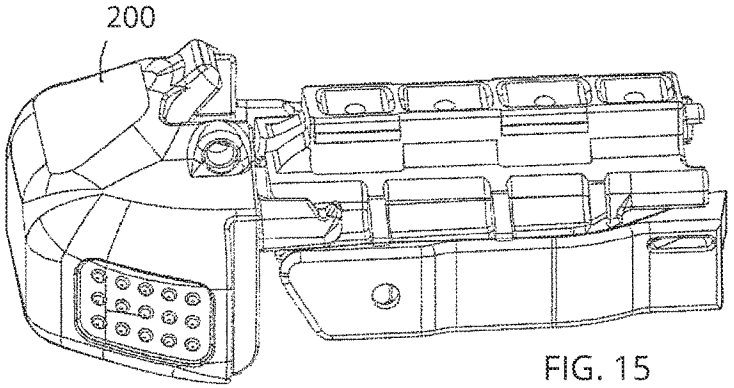
FIG. 15 is a perspective view of the retention means of FIGS. 12-14 without the handgun.
Figure 16:
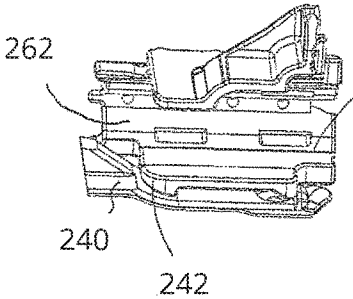
FIG. 16 is a perspective view of the sleeve and ejection port obstruction member as the cooperate in the holster.
Figure 17:
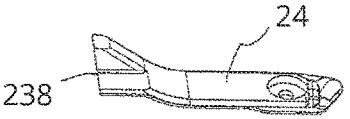
FIG. 17 is the same perspective view of FIG. 16 without the sleeve.

Referring to FIGS. 15-22F, a different embodiment of the holster retention mechanism is illustrated compared to FIGS. 10 and 11. The latch hood 200 has prongs 202, 204 are shorter than in the previous embodiment and have a notch 208 that precludes closure of the hood 200 without the downward (or forward) actuation of the sleeve 208. This assures the use of two retention mechanisms when the handgun is secured in the holster by way of precluding the latching of the pivot hood until the sleeve is forward which deflects the ejection port obstruction member. The sleeve has a top 210, sides 212, 214 and lower recess with a conforming shape to the handgun to be received. The sleeve engages the top surface of the handgun in the holster and has a T-shaped upper portion 220 that is received in the groove of the holster shell or body as illustrated best in FIG. 9. A thumb pushbutton 224 extends from a mid portion 226 of one of two side wall portions 212 which extend horizontal (when the axis of the gun and holster are horizontal) and taper downwardly.

Referring to FIGS. 22A to 22F, the sequence of operation of pivot hood retention mechanism is illustrated. FIG. 22*a* has the hood in the retention or obstruction position latched in place by the prongs resting on the platforms 234 of the sleeve 208. With the pushing of the pushbutton the result is illustrated in FIG. 22B and in FIG. 22C the sleeve no longer restricts the spring driven rotation of the hood and the hood is shown in a upward motion to the full open and release position of FIG. 22*d* and with the full downward position of the sleeve which then has the curved cam surface 242 of the sleeve fully deflecting outwardly the obstructing member 24 such that the stop surface 238 is in a non-obstructing position with respect to the handgun ejection port 244. FIG. 22*e* illustrates the sleeve sliding rearwardly (with respect to the handgun) or upwardly (with respect to the holster) and FIG. 22E illustrates the sleeve in its normal undepressed position and with the latch hood manually pivoted such that the grooves 208 are obstructed by the corners 252 of the platforms 234.

Figure 14:
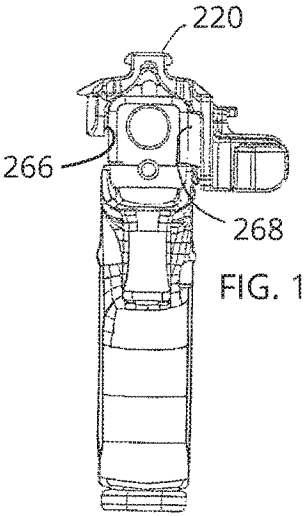
FIG. 14 is a view facing the front of the handgun an illustrating the relationship of the sleeve to the top surface of the handgun.
Figure 19:
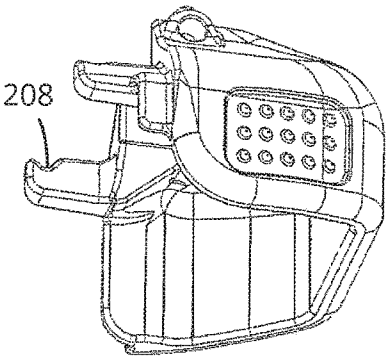
FIG. 19 is another perspective view of the latch hood of FIG. 18.
Figure 18:
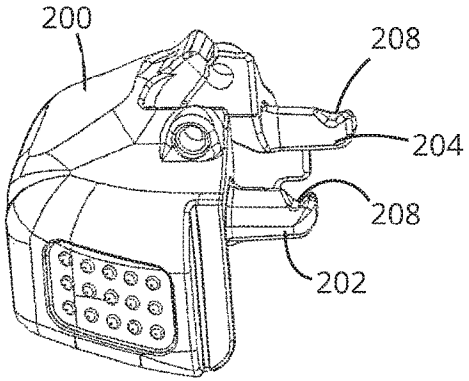
FIG. 18 is a perspective view of a different embodiment of a latch hood as compared to FIGS. 10 and 11.
Figure 21:
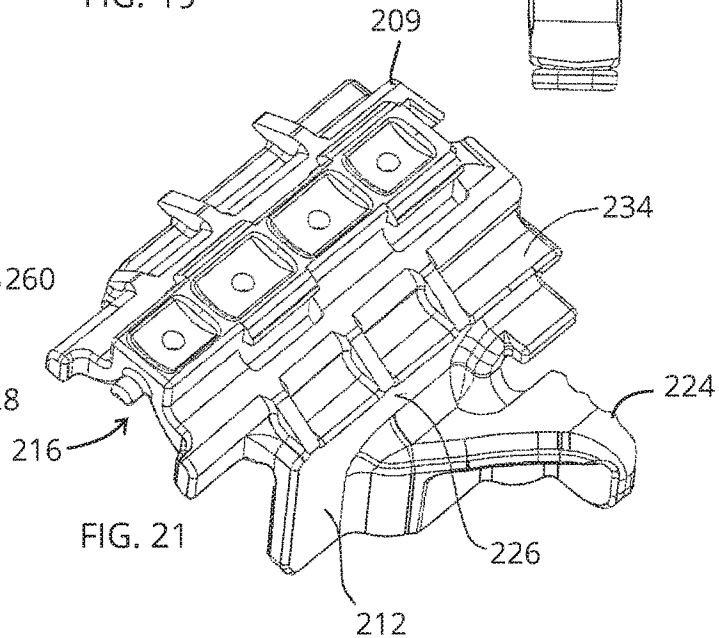
FIG. 21 is another perspective view of the actuation sleeve of FIG. 20.
Figure 20:
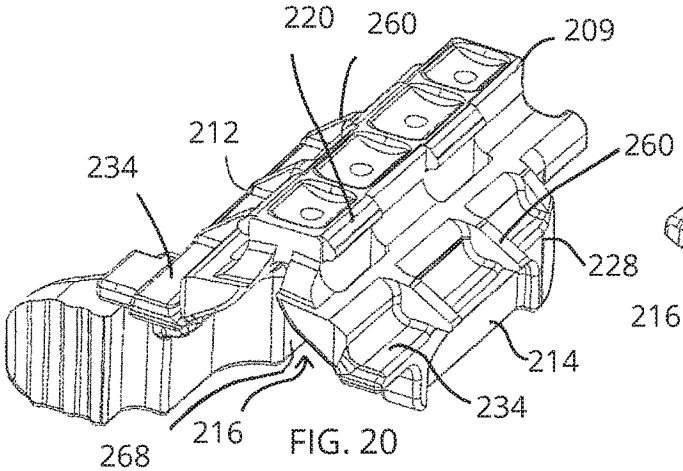
FIG. 20 is a perspective view of the actuation sleeve of FIGS. 12-16.

In addition to the T-shaped top portion 220, the sleeve may have bearing surfaces 260 on its sides to engage the inside surface of the holster body. The inside of the sleeve also has bearing surfaces 262 that engage the top surface of the handgun. Such bearing surfaces conform to the shape of the slide of the handgun. Also opposing side surfaces 266, 268 are parallel to each other and sandwich the slide of the handgun therebetween. As best illustrated by FIG. 14, the engagement of the handgun with the side surfaces may be a close fit with some tolerance to allow easy sliding of the handgun in and out of the holster without the slide gripping and impeding said insertion and withdrawal of the handgun.

The body and sleeve and ejection port obstructing member, and latch hood may be formed of injection molded polymers or composite construction. Generally the shell components, the sleeve, the obstructing member, and the latch hood will be rigid materials with some resilience. Nylons, polyethelenes, epoxies, may be suitable for example; such may be reinforced with glass, carbon or other fiber materials. Other materials may also be suitable, for example the ejection port obstructing member could readily be formed from spring steel or composite construction-polymer and steel.

The above references in all sections of this application are herein incorporated by references in their entirety for all purposes.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed:

1. A holster for a handgun, the holster comprising:

a holster body with a pair of opposing side walls defining a cavity for receiving and holding the handgun, the holster having a longitudinal axis extending parallel to a handgun insertion and withdrawal direction;

a slidably engaged member engaged with the holster body within the cavity of the holster body and slidably movable parallel to the longitudinal axis, the slidably engaged member coupled to a thumb push button, wherein when a handgun is received in the holster, the slidably engaged member surrounds at least two sides of the handgun;

a catch member attached to the holster body that engages with the handgun at a portion of the handgun, the catch member having a normal obstructing position with respect to the handgun the catch member movable to a non-obstructing position, the catch member cooperating with the slidably engaged member to move the catch member to the non-obstructing position;

a pivot guard pivotally coupled to the holster body for blocking removal of a handgun in the holster by obstructing the handgun at a slide of the handgun, the pivot guard having a closed capture position and an open release position, the pivot guard biased to the open release position, the pivot guard in engagement with the slidably engaged member when the slidably engaged member is in a first securement position and when the pivot guard is in the capture position, whereby when the thumb push button is pushed in a direction parallel to the longitudinal axis, the slidably engaged member is moved from the first securement position to a second release position, the pivot guard is released and moves to the open release position and the catch member moves to the non-obstructing position, wherein when a handgun is received in the holster, the handgun is in contact with the slidably engaged member.

2. The holster as set forth in claim 1, wherein the slidably engaged member is fixedly coupled to the thumb push button.

3. The holster as set forth in claim 1, wherein the release push button when pushed first disengages the pivot guard from the slidably engaged member and then sequentially disengages the catch member from the handgun.

4. The holster as set forth in claim 1, wherein the thumb push button is positioned between the holster body and a holster holding device and wherein the handgun insertion direction defines a forward direction and the thumb push button is position forward of the pivot guard.

5. The holster as set forth in claim 1, where in the pivot guard is configured as a hood that covers a top, two sides, and an end of a slide of a handgun that is holstered in the holster when the pivot guard is in the obstructing position.

6. A holster for a handgun, the holster comprising:

a holster body with a pair of opposing side walls defining a cavity for receiving and holding the handgun, the holster having a longitudinal axis extending parallel to a handgun insertion and withdrawal direction;

a slidably engaged member engaged with the holster body within the cavity of the holster body and slidably movable parallel to the longitudinal axis, the slidably engaged member coupled to a thumb push button, wherein when a handgun is received in the holster, the slidably engaged member surrounds at least two sides of the handgun;

a catch member attached to the holster body that engages with the handgun at a portion of the handgun, the catch member having a normal obstructing position with respect to the handgun the catch member movable to a non-obstructing position, the catch member cooperating with the slidably engaged member to move the catch member to the non-obstructing position;

a pivot guard pivotally coupled to the holster body for blocking removal of a handgun in the holster by obstructing the handgun at a slide of the handgun, the pivot guard having a closed capture position and an open release position, the pivot guard biased to the open release position, the pivot guard in engagement with the slidably engaged member when the slidably engaged member is in a first securement position and when the pivot guard is in the capture position, whereby when the thumb push button is pushed in a direction parallel to the longitudinal axis, the slidably engaged member is moved from the first securement position to a second release position, the pivot guard is released and moves to the open release position and the catch member moves to the non-obstructing position, wherein the catch member is configured as a leaf spring and the slidably engaged member is U-shaped and the catch member is positioned on a side of the holster body opposite to that of the thumb push button to engage an ejection port of a handgun holstered in the holster.

7. The holster as set forth in claim 6 in combination with the handgun.

8. A holster for a handgun, the handgun having an ejection port, the holster comprising:

a holster body with opposing sides defining a cavity for receiving and holding the handgun, the holster having a longitudinal axis extending parallel to an insertion/withdrawal direction;

a movable U-shaped member that is slidably engaged with the holster body and movable axially within the cavity of the holster body, the U-shaped member positioned to extend over a slide of a handgun when the handgun is holstered in the holster, the U-shaped member coupled to a thumb push button;

an ejection port catch member configured as a leaf spring attached to the holster body and that engages with the handgun at the ejection port of the handgun, the catch member having a normal obstructing position with respect to the handgun ejection port, the catch member movable to a non-obstructing position, the catch member cooperating with the U-shaped member to move the catch member to the non-obstructing position.

9. The holster of claim 8, further comprising a pivot hood pivotally coupled to the holster body, the pivot hood having a closed capture position and an open release position, the pivot hood biased to the open release position, the pivot hood in engagement with the axially movable member when the U-shaped member is in a first securement position and when the pivot hood is in the capture position, whereby when the U-shaped member is moved from the first securement position to a second release position, the pivot hood is released from the capture position and moves to the open release position.

10. The holster as set forth in claim 9, wherein the pivot hood has a pair of prongs for engaging with the U-shaped member.

11. The holster as set forth in claim 8, wherein the U-shaped member is engaged with a spring to urge the U-shaped member in an axial direction with respect to the holster.

12. The holster as set forth in claim 11, wherein the spring compresses when the thumb push button is pushed in a direction parallel to a holster insertion direction.

13. The holster of claim 8 wherein the thumb push button is integral with the U-shaped member.

14. The holster of claim 8 in combination with the handgun.

* * * * *